US006217940B1

(12) United States Patent
Kuni

(10) Patent No.: US 6,217,940 B1
(45) Date of Patent: Apr. 17, 2001

(54) METHOD AND APPARATUS FOR COATING A MOVING PAPERBOARD WEB

(75) Inventor: Stefan Kuni, Järvenpää (FI)

(73) Assignee: Valmet Corporation, Helsinki (FI)

( * ) Notice: Subject to any disclaimer, the term of this patent is extended or adjusted under 35 U.S.C. 154(b) by 0 days.

(21) Appl. No.: 09/297,541

(22) PCT Filed: Oct. 31, 1997

(86) PCT No.: PCT/FI97/00668

§ 371 Date: May 21, 1999

§ 102(e) Date: May 21, 1999

(87) PCT Pub. No.: WO98/20202

PCT Pub. Date: May 14, 1998

(30) Foreign Application Priority Data

Nov. 4, 1996 (FI) ..... 964430

(51) Int. Cl.[7] ..... B05D 1/36

(52) U.S. Cl. ..... 427/356; 427/358; 427/361; 427/395; 427/411; 427/420; 427/424

(58) Field of Search ..... 427/411, 179, 427/420, 424, 358, 361, 356, 395

(56) References Cited

U.S. PATENT DOCUMENTS

| | | | | |
|---|---|---|---|---|
| 2,937,955 | | 5/1960 | Loomer . | |
| 3,162,543 | * | 12/1964 | Wilkins | 427/411 |
| 3,627,564 | * | 12/1971 | Mercier | 427/411 |
| 4,233,346 | * | 11/1980 | Kerkhofs | 427/411 |
| 4,248,939 | * | 2/1981 | Parsons | 427/411 |
| 4,851,268 | * | 7/1989 | Kozak | 427/411 |
| 4,921,729 | | 5/1990 | Kaneko et al. . | |
| 5,169,715 | * | 12/1992 | Maubert et al. | 428/331 |
| 5,340,611 | * | 8/1994 | Kustermann et al. | 427/411 |
| 5,510,150 | | 4/1996 | Koskinen | 427/434.2 |
| 5,587,204 | * | 12/1996 | Kinsey, Jr. et al. | 427/411 |
| 5,588,998 | | 12/1996 | Koskinen | 118/410 |

FOREIGN PATENT DOCUMENTS

| | | |
|---|---|---|
| 0 130 814 | 1/1985 | (EP) . |
| 0 438 743A1 | 7/1991 | (EP) . |
| 0 791 686 A1 | 8/1997 | (EP) . |
| WO 95/12031 | 5/1995 | (WO) . |

* cited by examiner

*Primary Examiner*—Erma Cameron
(74) *Attorney, Agent, or Firm*—Cohen, Pontani, Lieberman & Pavane

(57) ABSTRACT

Method and apparatus for coating a moving paperboard web with at least two coating layers. A first coating layer is applied onto the surface of the web and a second coating layer is applied onto the surface of this first undried coating layer. The first coating layer is applied by means of a film transfer coater and the second coating layer is applied by means of a nozzle applicator, whereby the first layer is neither mixed nor doctored off the web during the application of the second layer.

29 Claims, 3 Drawing Sheets

METHOD AND APPARATUS FOR COATING A MOVING PAPERBOARD WEB

FIELD OF THE INVENTION

The present invention relates to a method and apparatus for coating paperboard with at least two coating layers.

The invention also relates to an arrangement for implementing the method.

BACKGROUND OF THE INVENTION

Paperboard can be coated with one or more coating layers in order to improve its printability. The more coating layers are applied, the higher the attained paper quality, simultaneously enabling the use of coating agents having different properties. However, the use of two coating layers entails a significant increase in production costs because the coating is usually carried out in separate steps, and the applied coating layer has been dried prior to the application of the next layer.

The coating can be performed either directly onto the board surface by means of, e.g., a blade or a rod coater, or by means of a film transfer coater whereby film which has been apportioned onto a film roll is transferred onto the paper surface in a roll nip. It is typical of the blade and rod coating methods that the doctor blade fills the roughness volume of the coating underlayer and evens out the surface whereby the thickness of the coat varies in accordance with the roughness volume variations of the coating underlayer. A smooth coat results, having an uneven brightness coverage, and the uniform absorption properties of the coat are difficult to control.

In film transfer coating, a coat of an essentially more uniform thickness is obtained rendering it easy to control the absorption properties, but sufficient smoothness properties pose a problem, particularly in the case of thicker papers and boards. The coating also provides quite an even coverage, whereby, for example, the brightness of a coating underlayer of low brightness can be significantly improved by means of this method. Furthermore, as no doctor blade trailing along the coating underlayer is involved in film transfer coating, the method offers excellent runnability with respect to coating breaks.

When paperboard is manufactured furnished with two or several coating layers, the investment costs involved are significant, because the coated web must be dried prior to the application of the next layer. This results in great length of the coating line, wherefore it requires a lot of room in the factory hall. The drying also requires a significant amount of thermal energy. Thus, it would be of advantage to apply the second coating layer onto a wet or damp first layer without any intermediate drying step. This, however, leads to problems in that the application and evening out of the second coating layer scrapes most of the first wet coating layer off the board surface and a thin final coat results, whereby at least some of the advantages of the duplex coating are lost.

SUMMARY OF THE INVENTION

The present invention is directed to a method and apparatus by which a paperboard web can be provided with two coating layers without any intermediate drying.

The invention is based on applying a second coating layer onto the first coating layer by means of a nozzle applicator device. The first layer is advantageously applied by means of a film transfer coater.

In more detail, the method according to the invention is characterized by what is stated in the characterizing part of claim 1.

The apparatus according to the invention, then, is characterized by what is stated in the characterizing part of claim 13.

The invention offers considerable benefits.

The most important benefits attained by the invention relate to improving the quality of the coated paper board. The coating method according to the invention achieves better coverage resulting in good optical smoothness of the surface. The coated surface obtained is very smooth and glossy. The unexpectedly good optical properties attained especially by means of one embodiment of the invention are based on the fact that, during the second coating step, the coating particles are preoriented in the direction of the web surface, thus achieving good coverage and brightness properties. Combining this with a coating layer of uniform thickness obtained by means of a film transfer coater will achieve a surface of essentially more even color than those produced by conventional methods. When performed by a nozzle applicator device comprising a small-angle blade or by an application nozzle, the application of the second layer does not impose similar strain on the damp first layer as does, for example, short-dwell application, and thus, the first coating layer is not scraped off the web surface when the second layer is applied. Thus, the solution according to the invention achieves a greater total coat weight than the previous wet-on-wet methods. By means of a film transfer coater, the web underside can be wetted in a controlled manner, thus avoiding warping of the board caused by water absorption from the coat by the web. The wetting of the underside of the web can be done with the same apparatus as the actual coating. The duplex coating according to the invention provides considerable savings in space compared to ordinary duplex coating where the web is dried prior to the application of the next layer. The invention is especially beneficial in coating paper board with an on-line coating apparatus since the web coming from the board making machine is usually hot, whereby the dry matter content rises rapidly when the coating mix of the first coating layer comes in contact with the hot web.

In addition to a film transfer coater, other methods can be used to apply the first coating layer. It is a fact that a film transfer coater usually provides the best coating quality and good runnability, but a similar coating layer can be achieved by means of applicator roll and pool coaters, a curtain coater apparatus, and nozzle coating devices and spray coaters, or even spray application devices. It is also feasible to use a device for applying the first coating layer, which evens out the coat by means of a doctor device, for example a short-dwell applicator, but this will achieve a poorer first-layer coverage than the above-listed devices. Correspondingly, a smoother first-layer surface is attained, resulting in a smoother final surface.

In the following, the invention is described in more detail by means of the annexed drawings.

Other objects and features of the present invention will become apparent from the following detailed description considered in conjunction with the accompanying drawings. It is to be understood, however, that the drawings are intended solely for purposes of illustration and not as a definition of the limits of the invention, for which reference should be made to the appended claims.

BRIEF DESCRIPTION OF THE DRAWINGS

In the drawings, wherein like reference numerals delineate similar elements throughout the several views.

DETAILED DESCRIPTION OF THE PRESENTLY PREFERRED EMBODIMENTS

The present invention relates to a wet-on-wet coating method and apparatus wherein a second coating layer is applied onto a wet first layer. In this context, the expression "wet first coating layer" is used to refer to a coating layer which has not been actively dried before the application of the second layer.

Figure 1:
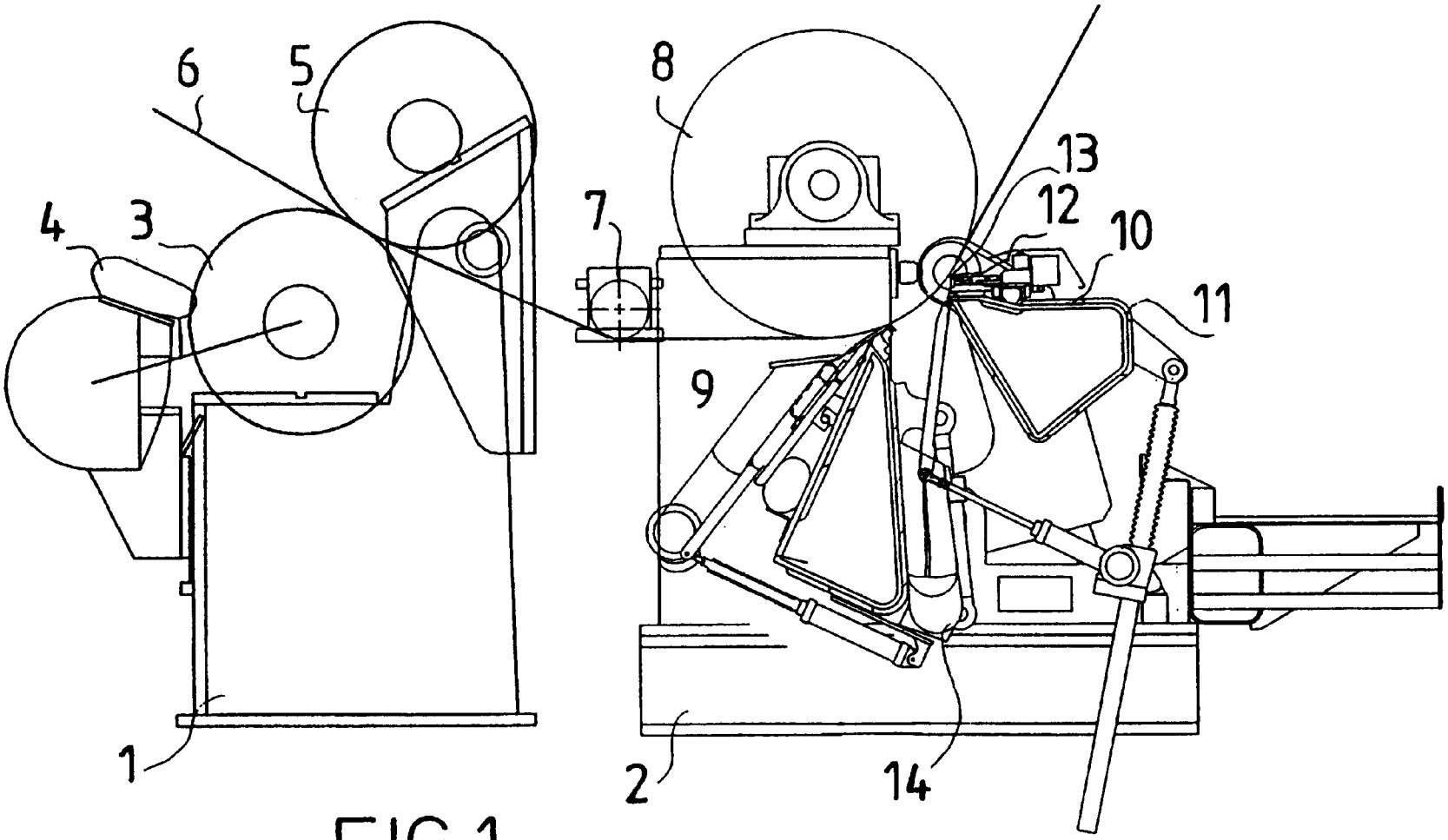
FIG. 1 is a schematic side view of an arrangement according to the invention.

The arrangement of FIG. 1 comprises a film transfer coater 1, a nozzle application device 2, a doctor 10 and a spreader roll 7 fitted in connection with the same backing roll 8 as the nozzle application device 2. The film transfer coater 1 comprises a film transfer roll 3 and a backing roll 5 forming a nip therewith, as well as application means 4 for spreading the coating mix onto the film transfer roll 3. Usually, an application device such as a short-dwell applicator is used as the application device 4, and most commonly, its doctor comprises a grooved rod. The application device 4 may also be constituted by a short-dwell device equipped with a blade, or some other similar means which can be used to obtain an even and accurately apportioned coating layer onto the surface of the film transfer roll 3. The web 6 to be coated travels through a nip formed by the film transfer roll 3 and the backing roll 5, wherein a coating layer adheres to the web 6 surface from the surface of the film transfer roll 3. The backing roll 5 comprises a dampening unit which can be used to apply water onto the roll surface so as to treat the underside of the web 6.

Figure 2:
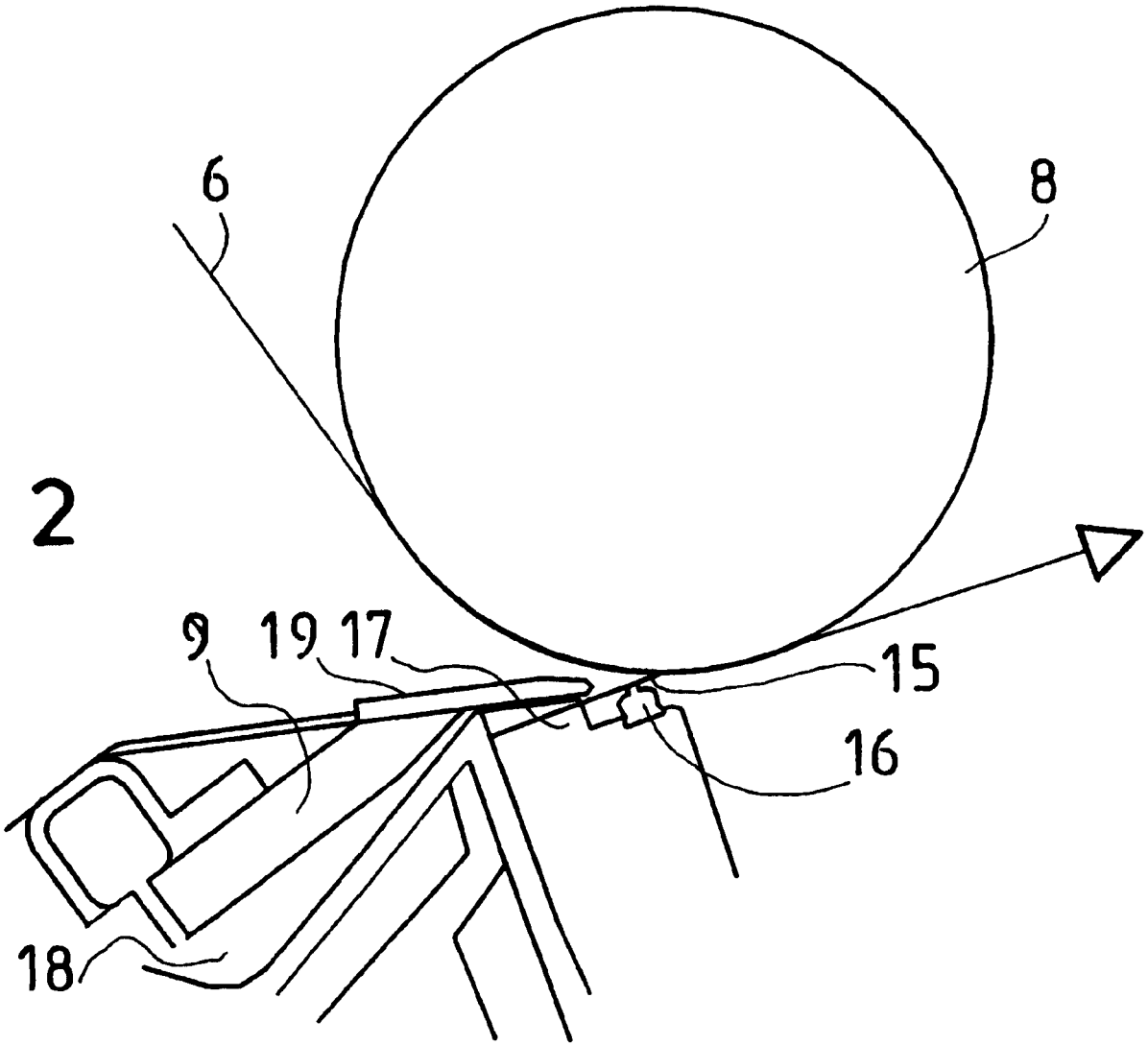
FIG. 2 is a schematic representation of a nozzle applicator device of the invention equipped with a pre-smoothing blade.

FIG. 2 is a blow-up of the nozzle applicator device 9 of the arrangement of FIG. 1, operating against a backing roll 8. The web 6 being coated travels between the backing roll 8 and the applicator 9. The applicator 9 comprises a pre-smoothing blade 15 fixed to a tool holder 17. The pre-smoothing blade 15 is adjusted at a small angle of about 0 to 25° in relation to the web 6 being coated, and thus, the coating mix applied onto the web 6 carries the blade 15 by means of hydrodynamic forces, resulting in relatively light scraping action. The scraping action is effected by means of a loading hose 16 adapted behind the pre-smoothing blade 15. The advantage of a small-angle blade lies in its relatively stable action even with large amounts of coating mix, this being of particular importance when coating board. In the production of high-quality printing boards, the large amount of coating mix is needed to achieve good printability, and some boards of poorer printability, such as packing board made of recycled fibers and unbleached board, must be coated with a thick coating layer because of the poor brightness of the base board, wherefore the coating is necessary in order to achieve at least reasonable printability.

The coating mix to be applied onto the web 6 is led to an application chamber 18 in the body of the device 9, and from there it is fed in as laminar a flow as possible to the root of the pre-smoothing blade 15. In the incoming direction of the web 6 the application chamber 18 is delimited by a lip 19 which in the operating position of the apparatus comes close to the web 6. A part of the coating brought to the pre-smoothing blade 15 sticks to the web 6 and a part flows back against the incoming direction of the web 6 preventing air inlet between the coat and the web at the application point. After the application, the coat is doctored to its final thickness using a separate doctor 10. As the doctor 10, any suitable doctor that contacts the web, for example doctor blade, smooth or grooved doctor bar, can be used. In the case of FIG. 1, the doctor is a trailing blade comprising a doctor blade 13 fixed to a frame beam 11 and loading and control means 12 for controlling the blade load and coat profile of the doctor blade 13.

The apparatus of FIG. 1 is used to manufacture duplex coated board. The board to be coated is first taken to a film transfer coater 1 which is used to apply a coating layer applied to the surface of the film transfer roll onto the web surface. This coating layer is of very uniform thickness and it also closely follows the roughness profile of the web, and thus, uniform coverage is achieved by the film transfer coater. The web 6 absorbs water from the applied coating layer giving rise to warping and swelling of the web. Warping can be reduced by applying water to the back side of the web, thus evening out the humidity of the web. The wetting of the web and the warping control is essential in board coating since the humidity gradients are steep because when the hot web is coated with wet coating, the absorption of water on the web is very different than that of a thinner and cooler paper web. Longitudinal elongation of the web is easily controlled by web tension, and elongation in the cross-direction of the web is controllable by means of the spreading roll 7.

The second coating layer is spread onto the web surface by means of a nozzle applicator device equipped with a pre-smoothing blade 15. The coating layer applied using the film transfer apparatus is already partly dry because water contained in the coating mix is absorbed by the web. The second coating layer is applied onto this slightly set layer. However, the first coating layer is still quite damp and will not endure a strong application pressure pulse. Therefore, nozzle application has been selected as the method used in applying the second layer. After the application of the second layer, the coating is doctored in the conventional manner to its final thickness by means of a doctor blade fitted in connection with the same backing roll 8. Superfluous coating mix flows from the doctor blade into a collector tray 14 and is returned to circulation from there. The distance between the nozzle applicator and the doctor blade can be adjusted whereby this adjustment of the setting time prior to doctoring can be used to influence the result of the doctoring. The amount of coating mix applied in nozzle application is relatively small, and thus, the doctoring force required is, correspondingly, smaller than that required in, e.g. roll application, wherefore the risk of the first coating layer being doctored off is reduced.

In addition to the above, the present invention provides other embodiments as well.

Figure 3:
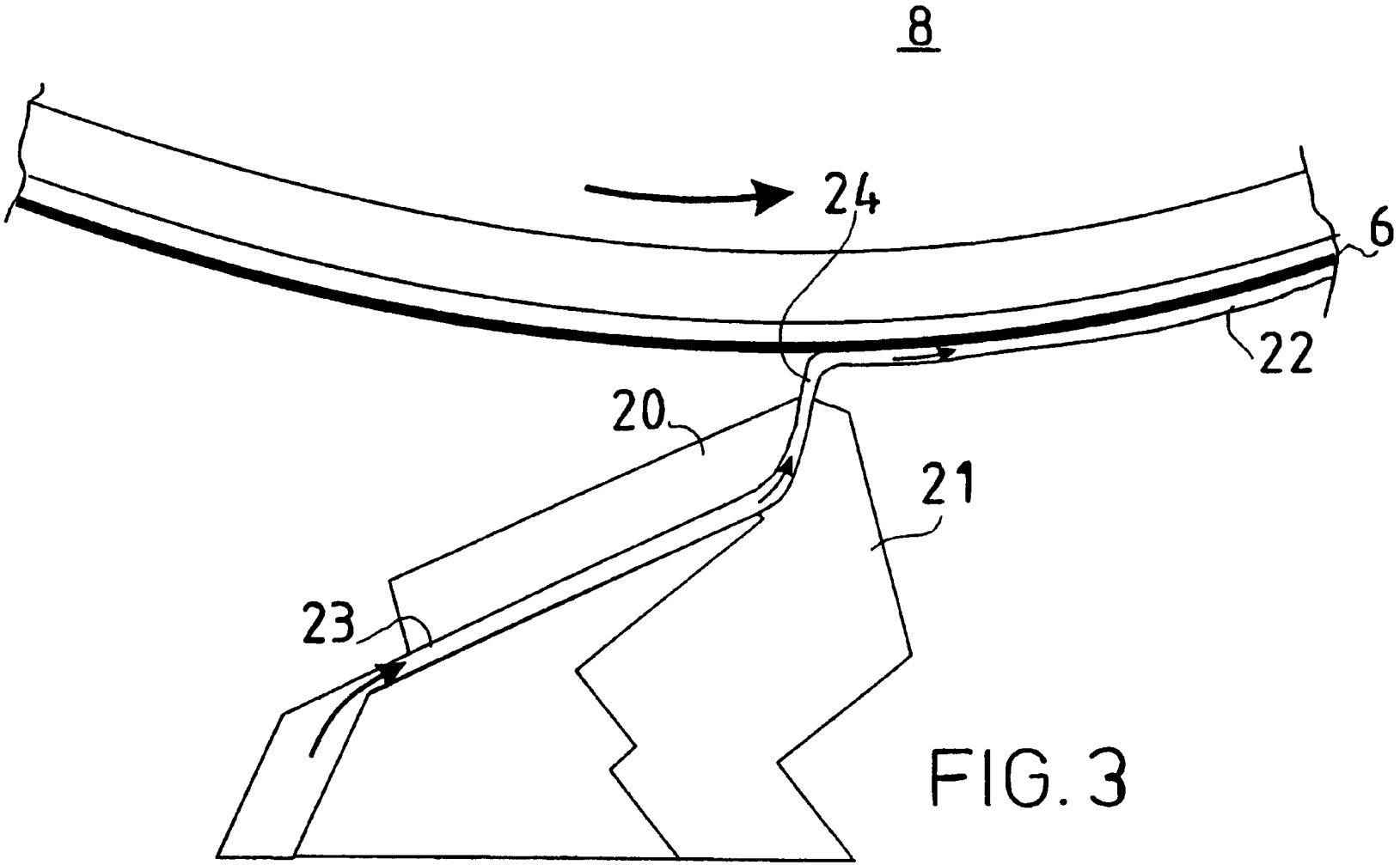
FIG. 3 depicts a nozzle applicator of the invention.

FIG. 3 depicts a jet-type applicator device which can be used instead of an applicator equipped with a pre-smoothing blade. In jet application, the coating mix is fed onto the web 6 through a narrow nozzle orifice 24 without the support of a pre-smoothing blade or the like. The nozzle orifice 24 is formed by an upper lip 21 and a lower lip 20 in the incoming direction of the web 6, the position and site of which can be altered to influence the breadth and position of the jet. The coating mix is fed to the nozzle orifice 24 through a narrow nozzle passage 23. The purpose of the nozzle passage 23 is to make the coating mix flow as laminar as possible in order to achieve an even coating jet. In jet application, the aim is to control the amount of coating mix such that the entire flow of coating mix from the nozzle orifice 24 is taken onto the web 6 to form an application layer 22, and thus, essentially no reflux flow occurs. In jet application, no application pressure pulse occurs, wherefore it is well suited for the application of a second layer onto an undried first layer of coating mix.

In the arrangement of the invention, other known nozzle application means may also be used. In this context, the term "nozzle application means" is used to refer to an apparatus with an extrusion die and possibly a pre-smoothing device but no doctor. The distance between the film transfer coater and the nozzle application may be adjustable, whereby the absorption of water by the web can be controlled by altering the delay time between the coating steps by means of adjusting the distance.

In order to prevent the web from warping, a dampener unit may be fitted in connection with one or both of the backing rolls 5, 8, the dampener unit being used to apply water to the uncoated surface of the web 6. The doctor can be omitted from the arrangement for instance when a nozzle applicator is used to apply a coat of desired thickness directly onto the web surface.

As already stated above, various means may be used to apply the first coating layer, those forming an applied layer of uniform thickness, e.g. roll coaters, being the best suited. The most advantageous method for applying the first layer would seem to comprise film transfer coating, and in some cases, methods comprising the use of a doctor blade or rod for smoothing are possible, this, however, changing the quality of the coat.

Thus, while there have been shown and described and pointed out fundamental novel features of the present invention as applied to a preferred embodiment thereof, it will be understood that various omissions and substitutions and changes in the form and details of the devices illustrated, and in their operation, may be made by those skilled in the art without departing from the spirit of the present invention. For example, it is expressly intended that all combinations of those elements and/or method steps which perform substantially the same function in substantially the same way to achieve the same results are within the scope of the invention. Substitutions of elements from one described embodiment to another are also fully intended and contemplated. It is also to be understood that the drawings are not necessarily drawn to scale but that they are merely conceptual in nature. It is the intention, therefore, to be limited only as indicated by the scope of the claims appended hereto.

What is claimed is:

1. A method for coating a moving paperboard web with at least two coating layers comprising:

applying a first coating layer to a surface of the web; and applying a second coating layer onto the first coating layer, the first coating layer not having been dried by any drying means prior to applying the second coating layer, the second coating layer being applied by one of a nozzle applicator and a jet applicator.

2. The method of claim 1, wherein the second coating layer is applied by a nozzle applicator.

3. The method of claim 2, wherein the nozzle applicator is furnished with a pre-smoothing means for smoothing the coating mix applied as the second coating layer.

4. The method of claim 1, wherein the second coating layer is applied by a jet applicator.

5. The method of claim 1, wherein the first coating layer is applied by a film transfer coater.

6. The method of claim 1, wherein the first coating layer is applied by an applicator roll coater.

7. The method of claim 1, wherein the first coating layer is applied by a nozzle coater.

8. The method of claim 1, wherein the first coating layer is applied by a spray coater.

9. The method of claim 1, wherein the first coating layer is applied by a pool coater.

10. The method of claim 1, wherein the first coating layer is applied by a curtain coater.

11. The method of claim 1, wherein a distance between a point where the first coating layer is applied to the web and a point where the second coating later is applied to the web is adjustable.

12. The method of claim 1, further comprising doctoring the coating layers applied to the web to a desired thickness after the second coating layer is applied to the web.

13. The method of claim 12, further comprising supporting the web by a backing roll as the second coating layer is applied to the web, wherein said doctoring is performed while the web is supported by the backing roll.

14. The method of claim 13, wherein a distance between a point where the first coating layer is applied to the web and a point where the second coating later is applied to the web is adjustable.

15. An apparatus for coating a moving paperboard web with at least two coating layers comprising:

means for applying a first coating layer to a surface of the web; and means for applying a second coating layer onto the first coating layer, wherein there is no drying means to dry the first coating layer interposed between said means for applying the first coating layer and said means for applying the second coating layer, said means for applying the second coating layer being one of a nozzle applicator and a jet applicator.

16. The apparatus of claim 15, wherein said means for applying the second coating layer is a nozzle applicator.

17. The apparatus of claim 16, further comprising a pre-smoothing means for smoothing the coating mix applied by said nozzle applicator.

18. The apparatus of claim 15, wherein said means for applying the second coating layer is a jet applicator.

19. The apparatus of claim 16, wherein said means for applying the first coating layer is a film transfer coater.

20. The apparatus of claim 15, wherein said means for applying the first coating layer is an applicator roll coater.

21. The apparatus of claim 15, wherein said means for applying the first coating layer is a nozzle coater.

22. The apparatus of claim 15, wherein said means for applying the first coating layer is a spray coater.

23. The apparatus of claim 15, wherein said means for applying the first coating layer is a pool coater.

24. The apparatus of claim 15, wherein said means for applying the first coating layer is a curtain coater.

25. The apparatus of claim 15, wherein a distance between a point where the first coating layer is applied to the web by said means for applying the first coating layer and a point where the second coating later is applied to the web by said means for applying the second coating layer is adjustable.

26. The apparatus of claim 15, further comprising a doctor means for doctoring coating applied to the web to a desired thickness after the second coating layer is applied to the web by said means for applying the second coating layer.

27. The apparatus of claim 26, further comprising a backing roll for supporting the web as the second coating layer is applied to the web by said means for applying the second coating layer, said doctor means doctoring the web while the web is supported by said backing roll.

28. The apparatus of claim 27, wherein a distance between a point where the first coating layer is applied to the web by said means for applying the first coating layer and a point where the second coating later is applied to the web by said means for applying the second coating layer is adjustable.

29. The apparatus of claim 26, wherein said doctor means is one of a contacting doctor, a doctor blade, a smooth doctor bar and a grooved doctor bar.

* * * * *